US005416678A

United States Patent [19]

Schabowski

[11] Patent Number: 5,416,678

[45] Date of Patent: May 16, 1995

[54] SOCKET WITH LIGHT CONCENTRATOR

[75] Inventor: Jeffrey R. Schabowski, Wauwatosa, Wis.

[73] Assignee: Santa's Best, Northfield, Ill.

[21] Appl. No.: 191,316

[22] Filed: Feb. 1, 1994

[51] Int. Cl.[6] ..... F21V 21/00

[52] U.S. Cl. ..... 362/249; 362/238; 362/252; 362/304; 362/806

[58] Field of Search ..... 362/240, 241, 238, 249, 362/252, 297, 304, 346, 349, 350, 806, 340, 353, 327

[56] References Cited

U.S. PATENT DOCUMENTS 3,761,678 9/1973 Eckles ..... 362/241 X
4,254,453 3/1981 Mouyard et al. ..... 362/241 X
4,795,121 1/1989 Comito ..... 362/806

*Primary Examiner*—Stephen F. Husar
*Attorney, Agent, or Firm*—Emrich & Dithmar

[57] ABSTRACT

A molded plastic figure which includes an elongated channel-shaped member having a bight portion intermediate two legs. A plurality of light concentrators are longitudinally spaced apart along the bight at predetermined intervals with each light concentrator having a frustoconical plastic body with an interior surface defining an axially extending opening. The interior surface of each concentrator defines a plurality of transparent vertically disposed cylindrical segments of increasing diameters. A halo of light appears at the exterior surface of the bight portion around each axially extending opening of each concentrator having a lighted bulb therein.

17 Claims, 1 Drawing Sheet

SOCKET WITH LIGHT CONCENTRATOR

BACKGROUND OF THE INVENTION

This invention relates to plastic figures particularly useful at Christmas time usually depicting sleighs, santa or elf figures, reindeer figures and the like. It is common to make Christmas figures which may be mounted in the windows or outside the home and are lighted in order to provide Christmas displays. In one aspect, the invention relates to Christmas figures of the type described in which the plastic support mechanism is such so that when the lights are operated, halos surround the lights which provide an interesting visual affect.

SUMMARY OF THE INVENTION

Accordingly, it is a principal object of the invention to provide a device which accommodates a series of lights which when lit, concentrates light to provide a halo affect around each of the light bulbs.

Another object of the invention is to provide a construction wherein each of a plurality of lights forming a holiday figure is surrounded by a halo of light.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE INVENTION

Figure 1:
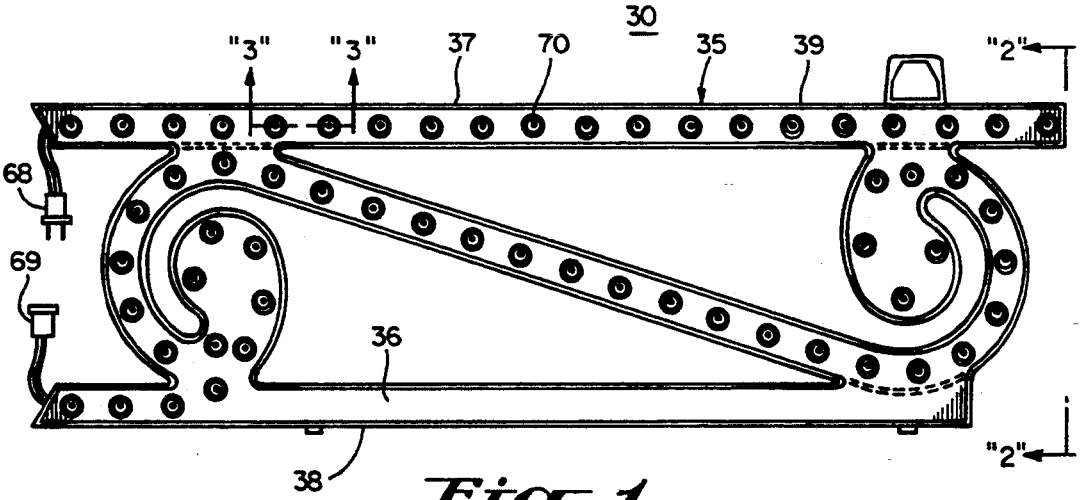
FIG. 1 is a front elevational view of a portion of a sleigh embodying the subject invention.
Figure 2:
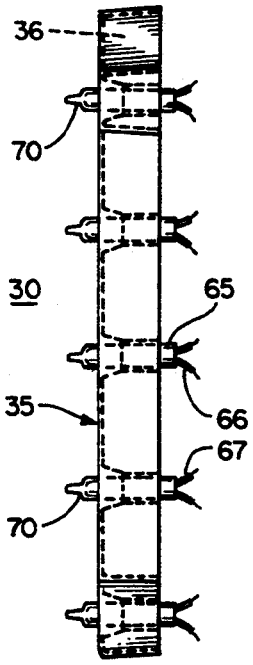
FIG. 2 is an end elevational view of the sleigh portion illustrated in FIG. 1 as seen along lines 2—2 thereof.

Referring now to the drawings, there is disclosed a plastic figure 30 which as illustrated is in the form of a section from a sleigh and is constructed of a channel shaped member 35 having a bight portion 36 and opposed legs 37 and 38 extending or positioned approximately 90° with respect to the bight portion 36. The area where the legs 37 and 38 meet the bight portion 36 is chamfered as at 39 and preferably forms an angle of about 45° with respect to the bight portion 36.

Spaced along the channel shaped member 35 are a plurality of light concentrators 45, each of the light concentrators includes a frustoconical body portion 46 from which integrally depends a cylindrical portion 47 having a detent 48 on the inner surface of the bottommost part of the cylindrical portion 47. There may be one or two detents per each 360° cylindrical portion 47.

The inner surface 50 of the frustoconical portion 46 is formed into a plurality of cylindrical segments each of which is larger than the next starting from the smallest segment 51 which is adjacent the cylindrical portion 47 of the light concentrator 45. Adjacent the small cylindrical segment 51 is the next segment 52 and onwards through segments 53, 54, and 55 with segment 55 being the largest segment and intersecting the surface 60 which corresponds to the bight portion 36 of the channel shaped member 35. A shoulder 56 is formed below the smallest cylindrical segment 51 and is the juncture between the inner surface 50 which is formed into the cylindrical segments 51 thru 55 and the cylindrical portion 47 of the light concentrator 45.

Figure 3:
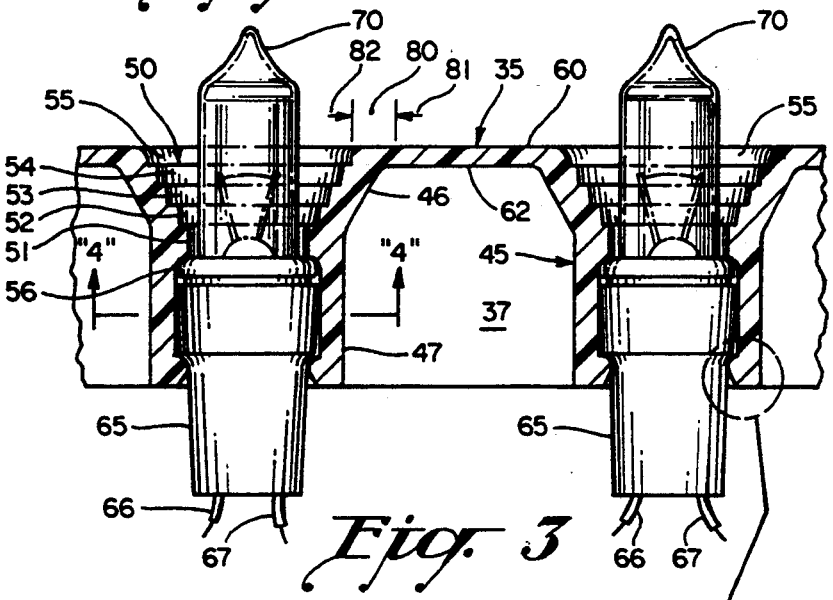
FIG. 3 is a sectional view of the sleigh portion of FIG. 1 as seen along lines 3—3 thereof.
Figure 4:
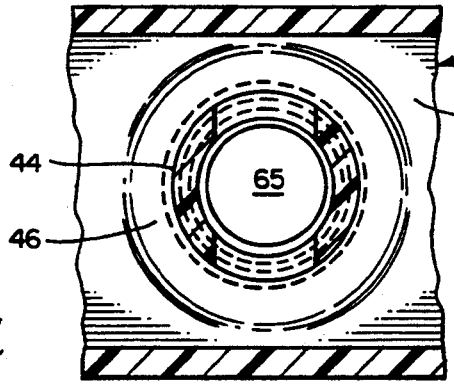
FIG. 4 is a sectional view of the socket and light concentrator of FIG. 3 as seen along lines 4—4 thereof.
Figure 5:
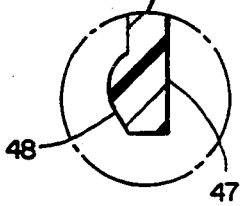
FIG. 5 is an enlarged view of the socket retaining device highlighted in FIG. 3.

The bight portion 36 of the channel shaped member 35, as previously described, has an upper surface 60 in which is flat and is intersected by the various inner surfaces 50 of the light concentrators 45. The opposite surface or the underneath surface of the bight portion 36 is labelled 62, as best seen in FIG. 3. A light socket 65 is positioned within each light concentrator 45 and as best seen in FIG. 3, is snugly abutted against the shoulder surface 56 and is held in place by the detent 48, spaced around the cylindrical portion 47. The cylindrical portion 47 of each of the concentrators 45 may have a vertically extending split therein to ensure that the cylindrical portion 47 is flexible to enable sockets 65 of various diameters to be inserted into each light concentrator 45.

Each of the light sockets 65 is provided with a pair of electrical wires 66, 67 which are connected to a male plug 68, a female plug 69 as well known in the Christmas decoration art, and similar to wiring that is used for Christmas tree lights. Finally, each of the light sockets 65 is provided with a bulb 70 which extends axially of the light concentrator 45 from the smallest cylindrical segment 51 to the largest cylindrical segment 55 and then beyond the surface 60 of the channel shaped member 35.

When the male plug 68 is connected to a source of electrical power, the light bulbs 70 illuminate and because of the construction previously described, a halo 80 is formed in a circular area surrounding the largest cylindrical segment 55 and generally extends between the juncture of the cylindrical segment 55 and an outer edge formed by the juncture of the frustoconical body portion 46 with the underneath surface 62 as denoted by the arrows 81, 2, in FIG. 3. The frustoconical surface 46 is preferably about 30° angularly disposed to the longitudinal axis of the light concentrator 45. It is believed that the reason that the halo 80 appears is because of the nature of the cylindrical segments 51 thru 55 and the fact that the frustoconical body portion 46 is made out of a clear or transparent plastic such as an acrylic or other suitable relatively hard plastic such as ABS. Whatever the actual reason, the visual effect of the plastic figure 30 is startling because when each of the bulbs 70 is lighted a halo 80 appears at the surface 60 which provides a very unusual and unique visual effect.

It should be understood that while a portion of a sleigh is depicted in FIG. 3, any suitable figure may be made with the light concentrator 45 of the present invention.

While there has been disclosed what is considered to be the preferred embodiment of the present invention, it is understood that various changes in the details may be made without departing from the spirit, or sacrificing any of the advantages of the present invention.

What is claimed is:

1. A light concentrator for a light bulb, comprising a frustoconical plastic body having an interior surface defining an axially extending opening, said interior surface defining a plurality of transparent vertically disposed cylindrical segments of increasing diameters, whereby a halo of light appears at the exterior surface of said frustoconical body around the axially extending opening when the light bulb is lit.

2. The light concentrator of claim 1, wherein said plastic is an acrylic.

3. The light concentrator of claim 1, wherein the light bulb is elongated and extends past the smallest cylindrical segment beyond the exterior surface of said frustoconical body.

4. The light concentrator of claim 1, wherein there are five cylindrical segments.

5. The light concentrator of claim 1, and further comprising means associated with said frustoconical plastic body for holding a light socket with a light bulb therein so the light bulb extends axially of said body.

6. The light concentrator of claim 5, wherein said means for holding a light socket comprises a cylindrical portion extending axially from the small end of the frustoconical plastic body, and gripping means on the interior of said cylindrical portion.

7. The light concentrator of claim 6, wherein the cylindrical portion is flexible to accommodate light sockets of varying diameters.

8. The light concentrator of claim 1, wherein the conical surface is about 30° angularly disposed from the longitudinal axis of the frustoconical body.

9. The light concentrator of claim 1, wherein the exterior surface at which the halo appears is perpendicular to the longitudinal axis of the frustoconical plastic body and terminates in a chamfered portion.

10. The light concentrator of claim 9, wherein the chamfered portion is angularly disposed about 45° with respect to the surface at which the halo appears.

11. A molded plastic figure comprising an elongated channel-shaped member having a bight portion intermediate two legs, a plurality of light concentrators longitudinally spaced apart along said bight at predetermined intervals, each light concentrator having a frustoconical plastic body with an interior surface defining an axially extending opening, said interior surface of each concentrator defining a plurality of transparent vertically disposed cylindrical segments of increasing diameters, whereby a halo of light appears at the exterior surface of said bight portion around each axially extending opening of each concentrator having a lighted bulb therein.

12. The molded plastic figure of claim 11, wherein each concentrator has means associated with said frustoconical plastic body for holding a light socket with a light bulb therein so the light bulb extends axially of said body.

13. The molded plastic figure of claim 12, wherein said means for holding a light socket in each concentrator comprises a light socket comprises a cylindrical portion extending axially from the small end of the frustoconical plastic body, and gripping means on the interior of said cylindrical portion.

14. The molded plastic figure of claim 11, wherein the cylindrical portion of each concentrator is flexible to accommodate light sockets of varying diameters.

15. The molded plastic figure of claim 11, wherein the conical surface of each concentrator is about 30° angularly disposed from the longitudinal axis of the frustoconical body.

16. The molded plastic figure of claim 11, wherein the junctures of the bight portion with the legs is chamfered.

17. The molded plastic figure of claim 16, wherein the chamfered portion is angularly disposed about 45° with respect to the surface at which the halo appears.

* * * * *